US007354306B2

(12) United States Patent
Thörner

(10) Patent No.: US 7,354,306 B2
(45) Date of Patent: Apr. 8, 2008

(54) POLE TERMINAL

(76) Inventor: Wolfgang B. Thörner, Hatzper Strasse 125, 45149 Essen (DE)

( * ) Notice: Subject to any disclaimer, the term of this patent is extended or adjusted under 35 U.S.C. 154(b) by 0 days.

(21) Appl. No.: 10/503,340

(22) PCT Filed: Dec. 24, 2002

(86) PCT No.: PCT/EP02/14752

§ 371 (c)(1),
(2), (4) Date: Aug. 2, 2004

(87) PCT Pub. No.: WO03/067719

PCT Pub. Date: Aug. 14, 2003

(65) Prior Publication Data

US 2005/0130493 A1 Jun. 16, 2005

(30) Foreign Application Priority Data

Feb. 2, 2002 (DE) ..... 102 04 373
Apr. 17, 2002 (DE) ..... 102 17 082

(51) Int. Cl.
*H01R 9/05* (2006.01)

(52) U.S. Cl. ..... 439/578; 439/583

(58) Field of Classification Search ..... 439/578–583, 439/551, 805, 939
See application file for complete search history.

(56) References Cited

U.S. PATENT DOCUMENTS 2,552,686 A * 5/1951 Melcher ..... 174/153 R
2,713,670 A 7/1955 Koch ..... 439/551
3,054,083 A 9/1962 Robert ..... 439/750
3,936,132 A * 2/1976 Hutter ..... 439/551
4,854,893 A * 8/1989 Morris ..... 439/578
5,308,266 A 5/1994 Booker ..... 439/817
5,354,217 A * 10/1994 Gabel et al. ..... 439/583
5,413,502 A * 5/1995 Wang ..... 439/551
5,435,745 A * 7/1995 Booth ..... 439/584
5,769,661 A * 6/1998 Nealis ..... 439/551
6,203,370 B1 * 3/2001 Lee ..... 439/589
6,590,777 B2 * 7/2003 Morino et al. ..... 361/736

FOREIGN PATENT DOCUMENTS

EP 0 054 123 6/1982

* cited by examiner

*Primary Examiner*—Hien Vu
(74) *Attorney, Agent, or Firm*—Collard & Roe, P.C.

(57) ABSTRACT

The invention relates to a pole terminal for producing an electrical connection. Said pole terminal comprises a metallic conductive body which is surrounded by an insulating body which can be fixed to the housing of an electrical appliance, and on which a tensioning nut can be screwed, said tensioning nut clamping the electrical conductor to be connected against the conductive body, establishing an electrical contact. The aim of the invention is to improve one such pole terminal in such a way that the conductive body can be produced from a material which is highly conductive, such as silver or copper. To this end, the conductive body is produced from a material exhibiting higher conductivity, by means of noncutting deformation, and is connected to the surrounding insulating body to form a composite body. Preferably, the conductive body is embodied as a stamped part which is machined by bending strain.

12 Claims, 2 Drawing Sheets

POLE TERMINAL

CROSS REFERENCE TO RELATED APPLICATIONS

Applicant claims priority under 35 U.S.C. §119 of German Application No. 102 04 373.6 filed Feb. 2, 2002. Applicant also claims priority under 35 U.S.C.§365 of PCT/EP02/14752 filed Dec. 24, 2002. The international application under PCT article 21(2) was not published in English.

The invention relates to a pole terminal for producing electrical conductive connections, having a metallic conductive body that is surrounded by an insulating body that can be fixed to the housing of an electrical device, onto which a tensioning nut can be screwed, which clamps the electrical conductor to be connected against the conductive body, producing an electrical contact.

BACKGROUND OF THE INVENTION

Such pole terminals are used, to a great extent, in entertainment electronics, in order to couple lines and, in particular, loudspeakers to the amplifiers. They are characterized in that they allow easy manual coupling and uncoupling. Their conductive and contact cross-sections should be designed in such a manner, in accordance with the conductivity of the material, that short power pulses, for example those of a loudspeaker signal, are not unnecessarily attenuated.

In the case of the known pole terminals, the conductive body is generally produced as a lathed part, from a material that is suitable for cutting machining, on the one hand, and electrically conductive, on the other hand. It is disadvantageous that a material that is suitable for cutting machining demonstrates a lower conductivity than the conductive material of the conductor to be connected, for example. This requires large conductive and contact cross-sections, in order to prevent the quality-reducing attenuation of power pulses. On the other hand, materials having a high level of conductivity, such as copper and silver, allow conductive and contact cross-sections analogous to those of the conductors to be connected. However, they are not suitable for cutting machining. They do not form chips; instead, they smear.

It is furthermore disadvantageous that the conductive bodies of the known pole terminals, as lathed parts, are configured in complex manner and are difficult to produce. Bores must be made to accommodate the external conductors to be connected. Threads are required to screw on components for bracing the external conductors, for fixing the pole terminal on the housing, or for accommodating the insulating body to secure it against external contacts. These and other design features are produced in separate production steps.

It is therefore the task of the invention to develop the pole terminal of the type stated initially further, in such a manner that the conductive body can be produced from a material that demonstrates a higher electrical conductivity, for example such as that of copper or silver. At the same time, the conductive body is supposed to be less complex, thereby reducing the production expense. A simpler structure furthermore proves to be user-friendly.

SUMMARY

To accomplish this task, the invention proposes, proceeding from the pole terminal of the type stated initially, that the conductive body is produced from a material having the highest conductivity, by means of non-cutting deformation, and is connected to the surrounding insulating body to form a composite body.

In the case of the pole terminal according to the invention, the conductive body is configured in such a manner that it can be punched from a metallic flat material, having the highest conductivity, for example copper or silver. By means of bending technology, it is given the shape necessary to fulfill the required functions. In order to accommodate the contact pin of a banana plug, the conductive body is configured, by means of bending technology, in such a manner, on its end facing away from the housing, that it forms ring-shaped contact surfaces coaxial to the longitudinal axis. For the electrical contact with the external conductor to be connected crosswise to the longitudinal axis of the pole terminal, the conductive body is given a contact surface angled in the crosswise direction to the longitudinal axis, by means of bending technology, which surface is subsequently aligned parallel to the longitudinal axis again. Therefore contacts to the external conductor are produced both in the longitudinal direction and in the crosswise direction.

It is advantageous that the material thickness can be significantly reduced as compared with the state of the art, because of the good conductivity of the materials used for the conductive body, such as copper or silver. Accordingly, the electrical attenuation is significantly lower.

The mechanical stability required for pole terminals is given to the conductive body according to the invention by means of the surrounding insulating body. The conductive body and the insulating body are combined to form a composite body. In order to guarantee a firm, positive-lock connection between the conductive body and the insulating body, the conductive body has recesses into which the insulating body engages. A saddle-like radial formation that surrounds the insulating body additionally provides security against torques resulting from rotational movements between the conductive body and the insulating body.

The insulating body is applied to the conductive body by means of injection-molding technology. In this process, the contact surfaces of the conductive body remain clear. These include the tube-like opening with the ring-shaped contact surface to accommodate the contact pin of a banana plug, the contact surface to accommodate an external electrical conductor, which surface runs crosswise to the longitudinal axis, and the contact outside the insulating body, which is configured as a solder terminal. In the region of the contact surface, the insulating body has an additional opening to accommodate the external electrical conductor.

At its end facing away from the housing, the insulating body is screwed together with a tensioning nut, by way of a saw-tooth thread. By way of a circumferential projection on the circumference of the insulating body and by way of projections on the inside of the tensioning nut, the movements of the nut are limited to such a dimension, in the axial direction, that it merely allows introduction and tensioning of the external electrical conductor. This automatic screw lock furthermore prevents the nut from being screwed off again.

It is advantageous that the tensioning nut consists of insulating material. As a result, the tensioning nut cap can be made of metallic material. This significantly improves both the haptics and the optics. A pressure ring is mounted to rotate between the tensioning nut and the surrounding tensioning nut cap, by way of a projection that runs around the external circumference of the tensioning nut, and a ring shoulder in the pressure ring. The pressure ring is axially moved by the tensioning nut. In this way, an external conductor introduced into the conductive body can be braced against a cap made of insulating material, which rests against the housing. A metallic ring having an exclusively optical function is laid into this insulating cap.

BRIEF DESCRIPTION OF THE DRAWINGS

An exemplary embodiment of the invention is explained in greater detail below, using the drawing. This shows.

DETAILED DESCRIPTION

Figures 1, 2:
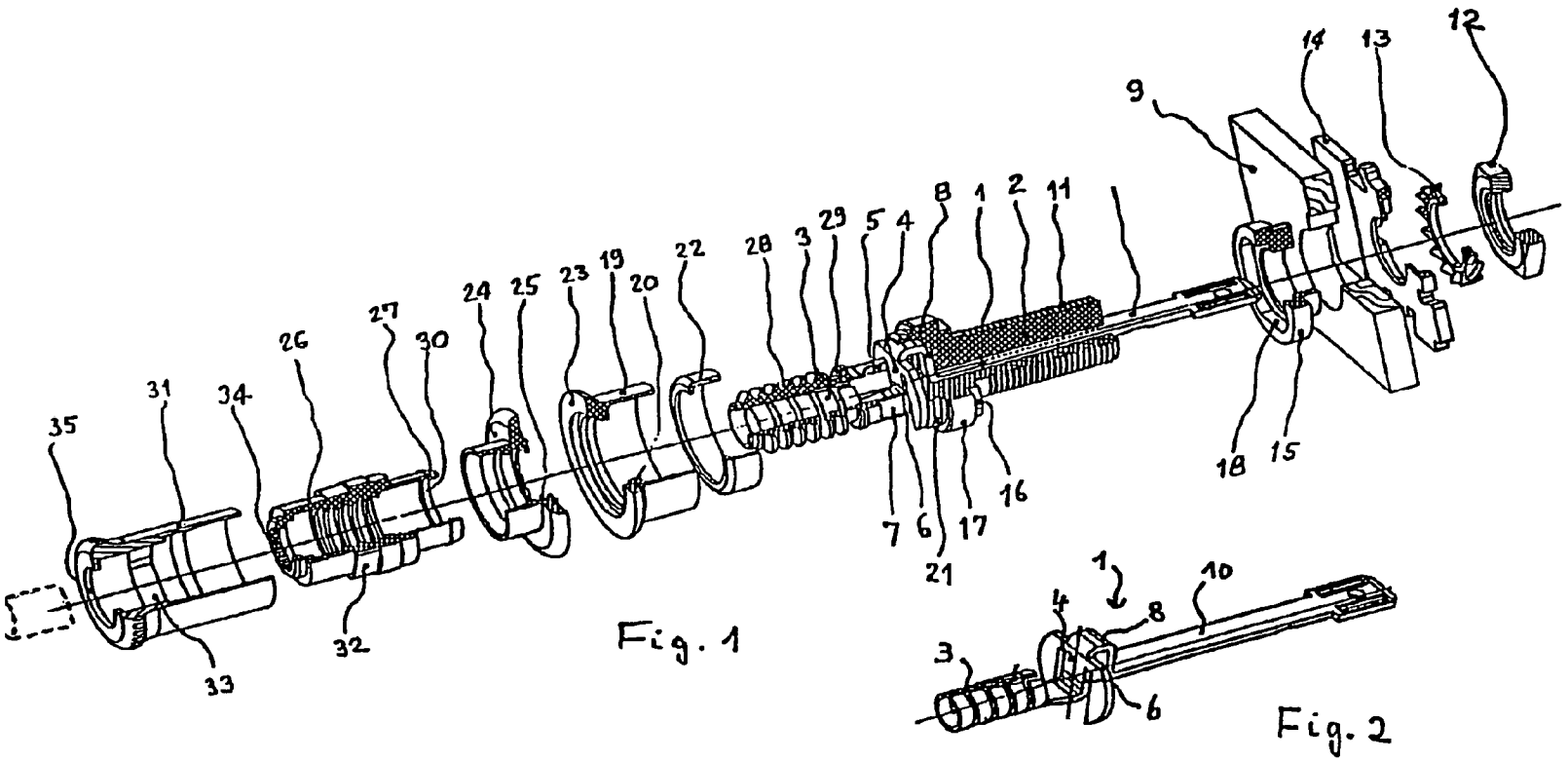
FIG. 1: an exploded view of a pole terminal according to the invention.
FIG. 2: the conductive body in a perspective view.

The pole terminal shown essentially consists of a metallic conductive body 1 that forms a composite body 1, 2 with a surrounding insulating body 2.

For connecting a banana plug, not shown, the conductive body 1 has a ring-shaped contact surface 3, parallel to its longitudinal axis, which is produced by means of bending technology. This surface is configured as a ridge with rings subsequently punched out crosswise to the longitudinal axis.

The continued conductive body 1 has a contact surface 4, produced by means of bending technology and running both parallel and crosswise to the longitudinal axis, for an external electrical conductor, not shown. The access to the contact surface 4 for the external conductor is made possible by an opening 5 in the insulating body 2. The contact surface 4 is widened crosswise to the longitudinal axis, and has slit-like recesses 6, in which the insulating body 2 engages with flattened shanks 7. Subsequent to the contact surface, the conductive body 1 forms a saddle 8, in which it is bent at first parallel to and then in the direction of the longitudinal axis of the pole terminal. This saddle 8 is anchored in the insulating body 2 and provides security against radial rotational movements between the conductive body and the insulating body 1, 2.

The conductive body 1 is extended, for example, for introduction into the housing 9 of a device of entertainment electronics, (See FIG. 3) It ends in an element 10, configured as a solder terminal, not surrounded by the insulating body 2, for connecting a line, not shown.

Figure 3:
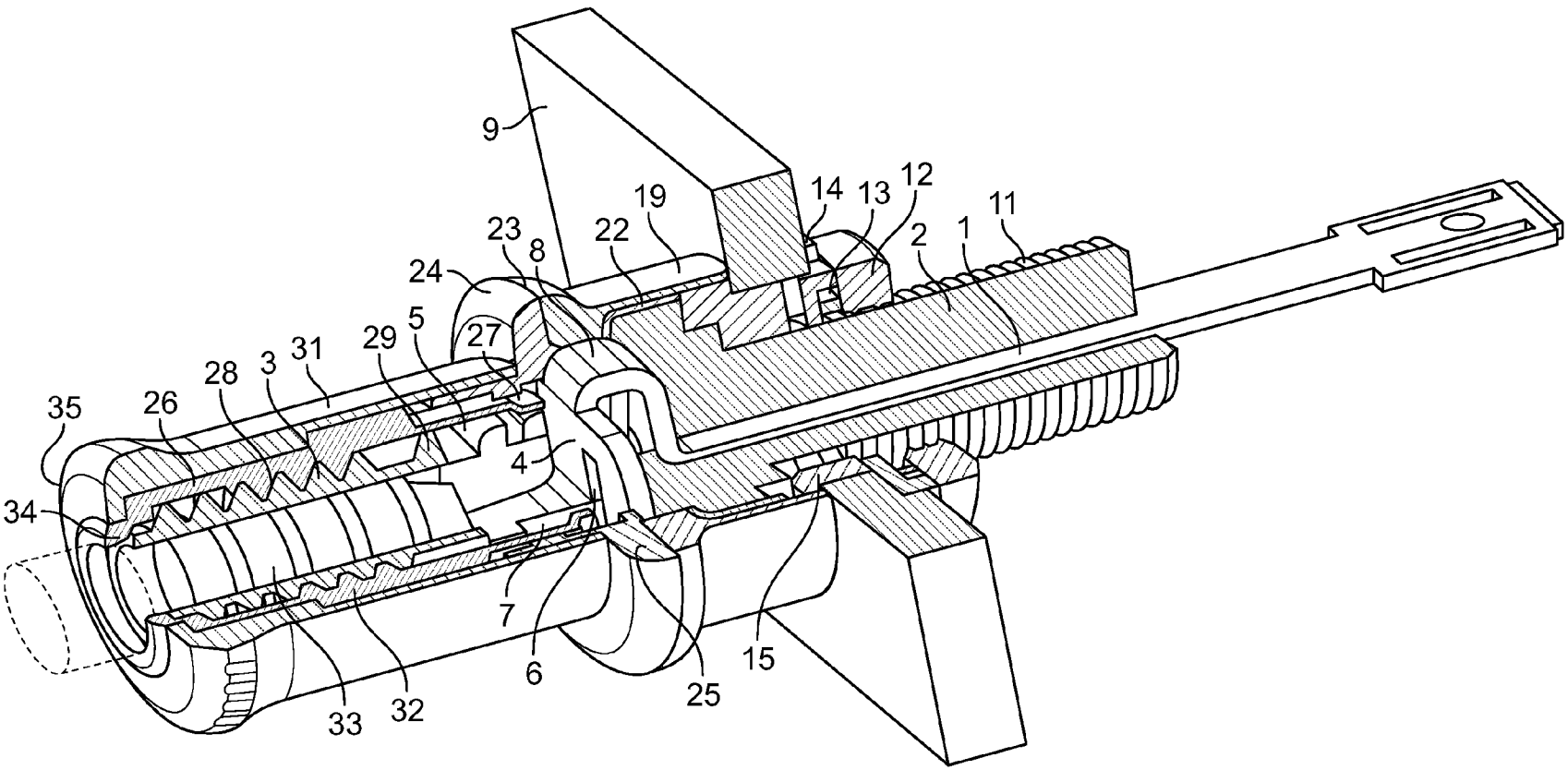
FIG. 3 shows a perspective, cross-sectional view of the pole terminal shown in FIG. 1.

As shown in FIGS. 1 and 3, the insulating body 2 is provided with a thread 11 on the housing side and, within the housing 9, is pressed against an insulating disk 14 and the housing 9 by means of a nut 12 made of insulating material, by way of a fan disk 13. The composite body 1, 2 is insulated from the outside, relative to the housing 9, by way of a double-step disk 15, and fixed in place for the screw connection. For this purpose, a stepped gradation 16 of the projection 16, 17 that runs on the circumference of the insulating body 2 engages into the outer step 18 of the double-step disk 15, forming a positive lock, while another stepped gradation 17 rests against the double-step disk 15. A cap 19 made of insulating, transparent material limits the distance between the housing 9 and the contact surface 4 for the external conductor to be guided in, crosswise to the longitudinal axis of the composite body 1, 2. It engages with a groove 21 that runs around the outside of the insulating body 2, with a projection 20 that runs around the inside. For optical reasons, a metal ring 22 is laid into the cap 19.

The edge 23 of the cap 19 that faces away from the housing serves, at the same time, as a counterpart for a pressure ring 24 for clamping the external conductor in place. The pressure ring 24 has a groove 25 that runs around the inside. The projection 27 that runs around a tensioning nut 26 on the outside engages in this groove. In this way, the pressure ring 24 is mounted so it can rotate, and can be displaced axially by way of the tensioning nut 26, but nevertheless independent of the rotational movements of the latter.

The tensioning nut 26 is screwed together with the insulating body 2, by way of a saw-tooth thread 28 on the outside of the insulating body 2. By way of projections 29 and 30 that run on the inside of the tensioning nut 26 and on the outside of the insulating body 2, the axial movements of the tensioning nut 26 are finite and defined in such a manner that merely the distance for introduction of the external conductor into the opening 5 of the insulating body 2 is released, and the tensioning nut 26 that has been screwed on cannot be screwed off again.

A tensioning nut cap 31 made of metallic material is set onto the tensioning nut 26, which is made of insulating material. The tensioning nut 26, on its outer circumference, and the tensioning nut cap 31, on its inner circumference, have flat surface formations 32, 33, whereby the adjustment moments are transferred from the tensioning nut cap 31 to the tensioning nut 26, with a positive lock. The tensioning nut 26 and the tensioning nut cap 31 have openings 34, 35, on their faces, for introduction of the contact pin of a banana plug, not shown, into the composite body 1, 2.

The invention claimed is:

1. A pole terminal for producing electrically conductive connections comprising:

a) a housing;

b) a metallic conductive body wherein said metallic conductive body is configured as a punched part and comprises:

i)a first contact section formed by a plurality of ring shaped electrical contact elements disposed on said metallic conductive body wherein said metallic conductive body is adapted to accommodate a contact pin of a banana plug, which runs coaxial to a longitudinal axis of the pole terminal;

ii) a second electrical contact section formed by a surface which runs crosswise to the longitudinal axis of the pole terminal;

iii) a third electrical contact section extending out from said second electrical contact section opposite said first contact section, substantially along the longitudinal axis of the pole terminal wherein said third electrical contact section is for connecting to a line, spaced apart from said second electrical contact section;

c) an insulating body surrounding said metallic conductive body said insulating body coupled to said housing, and having a ring shaped groove disposed outside of said housing;

d) a tensioning nut that can be screwed onto said insulating body;

e) a cap having a inner ring shaped projection made from insulating material; and g) a metallic cover ring in contact with said cap;

wherein said third electrical contact section extends outside of said insulating body and wherein said ring shaped projection of said cap engages with said ring shaped groove on said insulating body.

2. A pole terminal for producing electrically conductive connections comprising:

a) a single metallic conductive body wherein said conductive body is configured as a punched part;

b) an elongated insulating body surrounding said metallic conductive body, said insulating body adapted to be coupled to a housing; and c) an elongated tensioning nut that can be screwed onto said insulating body;

wherein said metallic conductive body comprises:

i) a set of first electrical contact surfaces that are ring-shaped and disposed on the end of the pole terminal facing away from the housing, wherein said set of first electrical contact surfaces runs coaxial to a longitudinal axis of the pole terminal;

ii) a second electrical contact surface wherein said second electrical contact surface is angled in a crosswise direction to the longitudinal axis of the pole terminal;

iii) a third electrical contact surface extending out from said second electrical contact surface, said third electrical contact surface extending outside of said insulating body and forming a connection end for connecting to a line: and wherein said elongated tensioning nut is arranged to clamp an electrical conductor to be connected against said second electrical contact surface to produce an electrical contact.

3. The pole terminal according to claim 2, wherein said conductive body consists of a material having the electrical conductivity equivalent to that of an external electrical conductor to be connected.

4. The pole terminal according to claim 2, wherein said conductive body is configured as a punched part having a plurality of recesses and saddle-like formations, and wherein said conductive body is coupled to said surrounding insulating body by means of said plurality of recesses and said radial bridge like formations.

5. The pole terminal according to claim 2, wherein said insulating body is applied to and firmly connected with said conductive body via injection-molding, whereby said conductive body is not enclosed by said insulating body at said conductive surfaces and at least one contact surface.

6. The pole terminal according to claim 2, wherein said insulating body has an opening which is adapted for connecting said insulating body to said electrical conductor to be connected.

7. The pole terminal according to claim 2, wherein said tensioning nut has a thread that is configured as a saw-tooth thread.

8. The pole terminal according to claim 2, further comprising a projection that extends around the outside of said insulating body, and wherein said tensioning nut, further comprises a plurality of projections disposed on an inner surface of said tensioning nut and which engage with said projection on said insulating body to limit a transversal adjustment of said tensioning nut relative to said insulating body, wherein said tensioning nut projections secure said tensioning nut from being screwed off.

9. The pole terminal according to claim 2, wherein said insulating body further comprises a thread, and wherein the device further comprises a plurality of insulating disks disposed on either side of said housing and at least one fan disk, formed as a nut made of insulating material.

10. The pole terminal according to claim 2, wherein said tensioning nut consists of insulating material and is covered by a metallic tensioning nut cap.

11. The pole terminal according to claim 2, further comprising a pressure ring and a tensioning nut cap, and wherein said tensioning nut further comprises a projection, wherein said pressure ring is fixed in place between said tensioning nut and said tensioning nut cap by way of said projection that runs around said tensioning nut so that said pressure ring exerts a clamping force on an electrical conductor that is introduced into said metallic conductive body, independent of a set of rotational movements of said tensioning nut.

12. The pole terminal according to claim 2, wherein said metallic conductive body is processed as a solder terminal on the contact side within the housing.

* * * * *